US009714514B2

(12) United States Patent
Scherrer

(10) Patent No.: US 9,714,514 B2
(45) Date of Patent: Jul. 25, 2017

(54) LIGHTED RAIL FOR A FALSE WALL WITH A STRETCHED CANVAS AND FALSE WALL COMPRISING SUCH A RAIL

(71) Applicant: NORMALU, Kembs (FR)

(72) Inventor: Jean-Marc Scherrer, Riedisheim (FR)

(73) Assignee: NORMALU, Kembs (FR)

( * ) Notice: Subject to any disclaimer, the term of this patent is extended or adjusted under 35 U.S.C. 154(b) by 0 days.

(21) Appl. No.: 14/805,654

(22) Filed: Jul. 22, 2015

(65) Prior Publication Data

US 2016/0024801 A1 Jan. 28, 2016

(30) Foreign Application Priority Data

Jul. 24, 2014 (EP) ..... 14178377

(51) Int. Cl.

| | |
|---|---|
| ***F21S 8/04*** | (2006.01) |
| ***E04F 13/26*** | (2006.01) |
| ***E04B 9/30*** | (2006.01) |
| ***E04F 13/00*** | (2006.01) |
| *F21Y 115/10* | (2016.01) |

(52) U.S. Cl.

CPC ..... *E04F 13/26* (2013.01); *E04B 9/303* (2013.01); *E04F 13/005* (2013.01); *E04F 2290/026* (2013.01); *F21S 8/04* (2013.01); *F21Y 2115/10* (2016.08)

(58) Field of Classification Search

CPC ... E04F 13/26; E04F 13/005; E04F 2290/026; E04B 9/903; F21Y 2101/02; F21S 8/04

See application file for complete search history.

(56) References Cited

U.S. PATENT DOCUMENTS

| | | | | |
|---|---|---|---|---|
| 4,137,424 | A * | 1/1979 | Hesse | H01R 25/14 174/97 |
| 5,029,422 | A * | 7/1991 | Scherrer | B44C 7/022 160/392 |
| 6,325,645 | B1 * | 12/2001 | Schuite | A47G 1/1686 439/110 |
| 7,607,268 | B2 * | 10/2009 | Scherrer | E04B 9/303 160/327 |
| 9,097,002 | B2 * | 8/2015 | Weithaller | E04B 9/303 |
| 9,440,661 | B2 * | 9/2016 | Burg | B61D 17/12 |

(Continued)

FOREIGN PATENT DOCUMENTS

| | | | | |
|---|---|---|---|---|
| DE | 4315499 | 11/1994 | | |
| DE | 10234317 A * | 3/2004 | | E04B 9/0428 |

(Continued)

OTHER PUBLICATIONS

European Search Report dated Jan. 21, 2015.

*Primary Examiner* — Jeanette E Chapman

(74) *Attorney, Agent, or Firm* — Bachman & LaPointe, P.C.

(57) ABSTRACT

The invention relates to a lighted rail for a false wall with a stretched canvas comprising a first wing for securing the rail onto a wall, a first channel so arranged as to enable the canvas to be hung and a second channel provided between the first channel and the first wing, and wherein lighting elements are mounted, characterized in that said rail comprises a cover partially closing the second channel, with said cover being so arranged as to extend under the lighting elements secured on a wall laterally delimiting the first and second channels with respect to each other.

5 Claims, 1 Drawing Sheet

(56) References Cited

U.S. PATENT DOCUMENTS

| | | | | |
|---|---|---|---|---|
| 2006/0156667 | A1* | 7/2006 | Scherrer | E04B 9/006 52/506.07 |
| 2010/0024333 | A1* | 2/2010 | Scherrer | E04F 13/005 52/273 |
| 2011/0061320 | A1* | 3/2011 | Scherrer | E04F 13/005 52/222 |
| 2011/0286216 | A1* | 11/2011 | Araman | F21V 29/004 362/249.02 |
| 2012/0051050 | A1* | 3/2012 | Lee | F21S 2/005 362/235 |

FOREIGN PATENT DOCUMENTS

| | | | | |
|---|---|---|---|---|
| FR | 2811693 | A1 * | 1/2002 | B44C 7/06 |
| FR | 2842845 | | 1/2004 | |
| FR | 2842845 | A1 * | 1/2004 | B44C 7/022 |
| FR | 2912438 | A1 * | 8/2008 | E04B 9/303 |
| FR | 2914667 | A1 * | 10/2008 | E04B 9/303 |
| FR | 2998316 | A1 * | 5/2014 | E04B 9/303 |
| KR | 101056123 | B1 * | 8/2011 | E04B 9/303 |
| WO | WO2014080124 | | 5/2014 | |

* cited by examiner

LIGHTED RAIL FOR A FALSE WALL WITH A STRETCHED CANVAS AND FALSE WALL COMPRISING SUCH A RAIL

BACKGROUND

The invention relates to the field of false walls (false ceilings or false walls).

The invention more particularly relates to a lighted rail for a false wall with a stretched canvas as well as a false wall comprising such a rail whereon a stretched canvas is secured.

STATE OF THE ART

A lighted rail for a false wall with a stretched canvas is known from the application WO2014/080124. The rail disclosed in this document comprises a rail section defining an outer wing for securing the rail to a wall, an inner channel provided with a shoulder for securing the sheet, and an outer channel provided between the inner channel and the outer wing, and a built-in lighting system secured at the bottom of the outer channel so as to provide downwards lighting. The rail further comprises a diffuser attached to the outer channel, which totally closes the latter. The diffuser, which aims at scattering the light emitted by the lighting system, is preferably made of a translucent material. It is fixed to the walls delimiting the outer channel, preferably using removable securing means.

The rail disclosed in the above-mentioned application has some drawbacks, however. First, such a rail does not provide the possibility of having an intense lighting because of the presence of the diffuser itself. Then, although the channel housing the lighting system is closed by a diffuser, the closing is rarely perfectly tight, so that volatile particles such as dust particles deposit inside the channel and deposit on the diffuser over time. When the lighting system is operating, the particles then present on the inner face of the diffuser affect the light rendering of the rail through the diffuser, with such particles looking like black stains. Besides, securing a diffuser on the channel remains a relatively long and tedious operation.

The invention aims at remedying such problems by providing a lighted rail providing glare-free intense lighting while avoiding any shadow projection or shadow area.

The invention also aims at providing an aesthetic lighted rail preserving an easy mounting of the canvas.

SUMMARY

For this purpose, and according to a first aspect, the invention provides a rail for a false wall with a stretched canvas, comprising a first wing for securing the rail onto a wall, a first channel so arranged as to enable the canvas to be hung and a second channel provided between the first channel and the first wing, and wherein lighting elements are mounted, characterized in that said rail comprises a cover partially closing the second channel, with said cover being so arranged as to extend under the lighting elements fixed on a wall laterally delimiting the first and second channels with respect to each other.

The intensity of the light emitted by the lighting elements is thus preserved, while remaining glare-free, thanks to the position of such lighting elements in the channel and to the presence of a cover positioned under the lighting elements. The presence of a cover under the lighting elements additionally makes it possible to hide the lighting elements, the electrical system associated thereto as well as any unaesthetic element such as the fixing elements. Any shadow projection or shadow area in the vicinity of the sheet is further eliminated.

The wall advantageously comprises a shoulder extending toward the inside of the second channel, with said shoulder forming the cover. Such configuration is advantageous in that it makes it possible not to use any additional element to be secured to the rail upon the positioning of the lighting elements in the channel, since the cover is directly built in the rail. The production of the rail is thus simplified, since the cover is formed during the manufacturing of the rail, so that the operation aiming at lighting the rail is limited to the securing of the lighting elements on the side wall of the channel.

The shoulder is advantageously provided at the end of the wall and has an extension which extends toward the inside of the first channel, with said extension forming a shoulder for hanging the canvas. Such position thus avoids any shadow area at the channel housing the canvas.

The wall advantageously converges toward the plane containing the first wing. Such configuration makes it possible to hide the lighting elements.

The shoulder advantageously has a length between 6 and 7 millimeters. Such range of length makes it possible to provide an efficient hiding of the lighting elements while providing a sufficient access for securing the lighting elements as well as an optimum opening for the diffusion of light.

The lighting elements advantageously comprise electroluminescent diodes.

The rail advantageously comprises a second wing laterally delimiting, together with the wall, the first channel, with the second wing extending substantially parallel to the wall.

The invention also relates to a false wall comprising at least a rail according to any one of the preceding claims, and a stretched canvas secured in the first channel of said rail.

BRIEF DESCRIPTION OF THE DRAWINGS

Other objects and advantages of the invention will be apparent from the following description, given hereafter with reference to the appended drawings wherein.

For clarity, the identical or similar elements in the various embodiments are referred to using identical references in all figures.

Besides, the words "vertical", "horizontal", "lower", "upper", "down" are defined hereunder while referring to the position of the rails shown in the figures.

DETAILED DESCRIPTION

Figure 1:
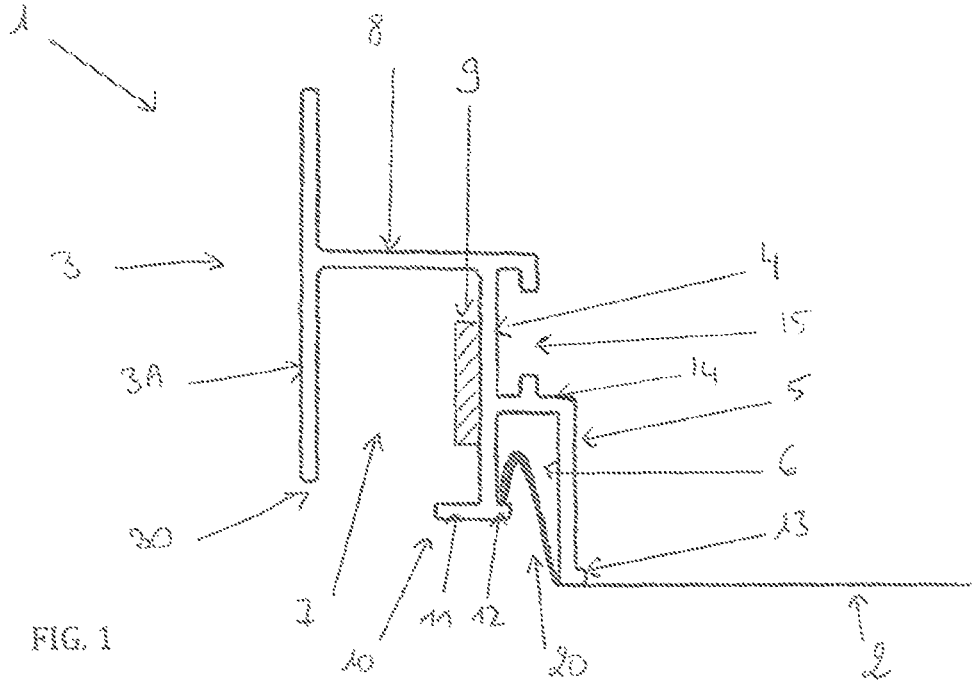
FIG. 1 is a sectional view of a rail for a false wall according to a first embodiment of the invention, whereon a stretched canvas is hung.
Figure 2:
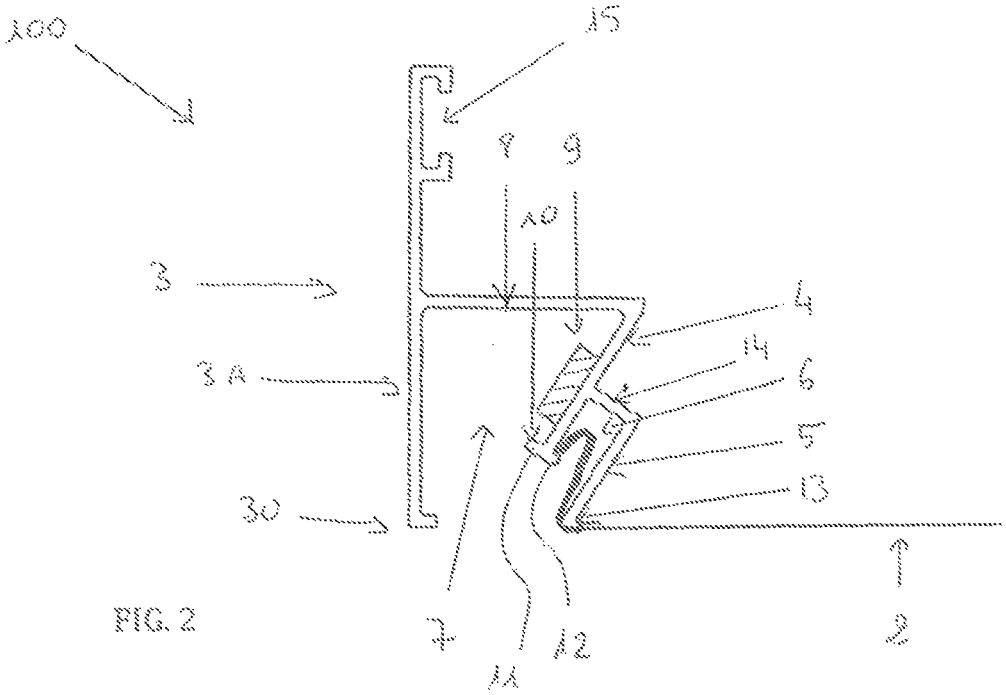
FIG. 2 is a sectional view of a rail for a false wall according to a second embodiment of the invention, whereon a stretched canvas is hung.

The rails shown in FIGS. 1 and 2 are intended to be secured to a wall to form a false ceiling together with the stretched canvas. The figures show the positions of the rails when same are fixed to a wall.

FIG. 1 illustrates a first embodiment of a lighted rail 1 whereon a stretched canvas 2 is hung.

The rail 1 comprises a rail section having a first wing 3 for securing the rail 1 onto a wall 4, a first channel 6 so arranged as to enable the securing of the canvas 2 and a second channel 7 arranged between the first channel 6 and the first wing 3. In the illustrated embodiment, the first wing 3 is vertical.

The first and second channels 6, 7 respectively show an opening oriented downwards. These are laterally delimited with respect to each other by a wall 4, hereafter called the common wall 4. In the illustrated embodiment, the common wall 4 extends parallel to the first wing 3.

The common wall 4 is connected to the first wing 3 by a core 8 which substantially extends perpendicularly to the first wing 3. In the illustrated embodiment, the core 8 extends halfway up the first wing 3. The second channel 7 is thus laterally delimited by the portion of the first wing 3 which extends under the core 8 (lower portion 3A) and the common wall 4, with the core 8 forming the bottom of the second channel 7. The rail 1 according to the invention is of course not limited to this configuration and a core extending to another height of the first wing than the one illustrated, as well as at one of the ends of the latter, may also be provided.

The rail section has a second wing 5 parallel to the common wall 4. It has, on its lower end, a lug 13 which extends perpendicularly in the direction opposite the first wing 3. The second wing 5 is connected to the common wall 4 by an arm 14. In the illustrated embodiment, the arm 14 extends halfway up the common wall 4. The first channel 6 is thus laterally delimited by the second wing 5 and the portion of the common wall 4 which extends under the arm 14, with the arm 14 forming the bottom of the first channel 6. The rail 1 according to the invention is of course not limited to such configuration and an arm extending to another height of the common wall than the one illustrated, as well as an extension of the core 8 may also be provided.

As shown in FIG. 1, the portion of the common wall 4 located above the arm 14 is so arranged as to define a rail 15 intended to receive means for assembling the rail section with another rail section.

The second channel 7 comprises electroluminescent diodes 9, or any other lighting element, secured to the common wall 4. In the illustrated embodiment, the diodes 9 are secured directly onto the common wall 4. According to an advantageous configuration, the diodes 9 may be secured onto the common wall 4 through a support which may be a blade (not shown). Such arrangement is advantageous in that it enables a quick and easy securing of the diodes 9 onto the common wall 4, with said diodes being previously secured onto the support so that they can be fixed by simply securing the support onto the common wall 4.

In order to avoid any unaesthetic aspect of the diodes 9, of the elements fixing same and the electrical system associated thereto, while preserving a sufficient gap for diffusing the light from the diodes 9, the rail 1 comprises a cover 10 partially closing the second channel 7, with said means being so arranged as to extend under the diodes 9. In the illustrated embodiment, the cover 10 consists of a shoulder 11 which extends toward the inside of the second channel 7 on a sufficient length to hide the diodes 9 to the eyes of a user standing under the false ceiling. For this purpose, a shoulder having a length between 6 and 7 millimeters may advantageously be provided.

In the illustrated embodiment, the shoulder 11 is provided at the lower end of the common wall 4. It also has an extension 12, which extends toward the inside of the first channel 6, with said extension 12 forming a shoulder for hanging a hook 20 or any other equivalent means provided on the edge of the canvas 2. The shoulder and the extension 12 extend substantially perpendicularly to the common wall 4.

In the illustrated embodiment, the first wing 3, the common wall 4 and the second wing 5 are all parallel. The common wall 4 extends beyond the lower portion of the first wing 3. This makes it possible to ensure a lighted surrounding without any shadow area.

FIG. 2 shows a second embodiment of a lighted rail 100 whereon a stretched canvas 2 is hung.

Such rail 100 uses all the characteristics of the rail 1 described above. It is different, however, by the orientation of the common wall 4 and of the second wing 5.

More particularly, the common wall 4 is so arranged as to converge towards the lower portion 3A of the first wing 3. Such inclination of the common wall 4 makes it possible to improve the masking of the diodes 9, the diodes fixing elements and the electrical system associated thereto.

In order to also improve hiding the elements securing the canvas 2 onto the rail 100 (a hook 20 or equivalent means), the second wing 5 is also inclined so as to converge towards the lower portion of the first wing 3. In the illustrated embodiment, the second wing 5 extends parallel to the common wall 4.

As mentioned above, the shoulder 11 and the extension 12 thereof are provided at the end of the common wall 4 and extend substantially perpendicularly to the common wall 4.

In the illustrated embodiment, the second wing 5 has a length such that its free end (the end whereon the canvas supporting lug is provided) is located at the same level as the free end 30 of the lower portion 3A of the first wing. The dimensions of the common wall 4 are such that one of its end stops at a higher level than the lower end 30 of the lower portion 3A of the first wing 3. The common wall 4 advantageously has a length such that the extension 12 and the free end of the second wing 5 are aligned substantially vertically. Such configuration is advantageous in that it makes the hook invisible to a person standing under the false ceiling, and more particularly directly under the rail.

In the illustrated embodiment, the rail 15 provided for assembling the rail section with another rail section is carried by the portion of the first wing 3 which is located above the core 8.

The invention has been described above as an example. The persons skilled in the art will of course be able to provide various alternative embodiments of the invention without leaving the scope thereof.

The invention claimed is:

1. A rail for a false wall with a stretched canvas, comprising:

a first wing configured to secure the rail onto a wall, a first channel configured to enable the canvas to be hung, and a second channel, opening downwards, provided between the first channel and the first wing, said first and second channels being delimited laterally by a common wall, and lighting elements mounted in said second channel, wherein said rail comprises a cover partially closing the second channel, said cover configured to extend under the lighting elements secured on said common wall, wherein the common wall converges toward a plane containing the first wing.

2. The rail according to claim 1, wherein the common wall comprises a shoulder extending toward the inside of the second channel, with said shoulder forming the cover.

3. The rail according to claim 2, wherein the shoulder provided at the end of the common wall has an extension which extends toward the inside of the first channel, with said extension forming a shoulder for hanging the canvas.

4. The rail according to claim 1, wherein the lighting elements comprise electroluminescent diodes.

5. The rail according to claim 1, wherein said rail comprises a second wing laterally delimiting, together with the common wall, the first channel, with the second wing extending substantially parallel to the common wall.

* * * * *